United States Patent [19]

Bodley et al.

[11] 4,036,394

[45] July 19, 1977

[54] FLOATING ROOF FOR LIQUID STORAGE TANKS

[75] Inventors: Robert W. Bodley, Highland; Reign C. Ulm, Schererville, both of Ind.

[73] Assignee: Aerojet-General Corporation, El Monte, Calif.

[21] Appl. No.: 603,844

[22] Filed: Aug. 11, 1975

Related U.S. Application Data

[63] Continuation of Ser. No. 342,454, March 19, 1973, abandoned.

[51] Int. Cl.[2] ..... B65D 87/20

[52] U.S. Cl. ..... 220/222; 220/220

[58] Field of Search ..... 220/216–227

[56] References Cited

U.S. PATENT DOCUMENTS

| | | | |
|---|---|---|---|
| 1,819,401 | 8/1931 | Bailey | 220/218 |
| 1,931,546 | 10/1933 | Horton | 220/221 |
| 2,036,372 | 4/1936 | Stough | 220/222 |
| 2,281,748 | 5/1942 | Carney | 220/227 |
| 2,359,416 | 10/1944 | Hammeren | 220/219 |
| 2,586,856 | 2/1952 | Orr et al. | 220/219 |
| 2,854,223 | 9/1958 | Lee | 220/222 X |
| 2,867,346 | 1/1959 | Champagnat | 220/217 |
| 2,867,347 | 1/1959 | Champagnat | 220/227 |
| 3,029,971 | 4/1962 | Reynolds | 220/218 |
| 3,104,775 | 9/1963 | Champagnat | 220/220 |
| 3,313,443 | 4/1967 | Dial et al. | 220/219 |
| 3,374,918 | 3/1968 | Creith | 220/216 |
| 3,493,143 | 2/1970 | Thompson et al. | 220/222 X |
| 3,690,502 | 9/1972 | Guber, Jr. | 220/219 |
| 3,724,704 | 4/1973 | Edwards et al. | 220/226 |
| 3,774,799 | 11/1973 | Heisterberg | 220/216 |
| 3,861,555 | 1/1975 | Nelson | 220/221 |

*Primary Examiner*—Stephen Marcus
*Attorney, Agent, or Firm*—Edward O. Ansell

[57] ABSTRACT

A floating roof for a liquid storage tank has a lid structure comprising a plurality of fluid tight interconnected plates of fluid tight material and a plurality of buoys for imparting buoyancy to the lid structure arranged on the surface of the lid which is opposite the surface of the lid which faces the liquid body upon which the lid floats. Each buoy of at least a majority of the buoys has a base formed of one of said plates, and further includes structure attached to the base and having at least two sides inclined relative to a perpendicular plane through the lid structure and relative to each other.

A similar floating roof for a liquid storage tank has again a lid structure and a plurality of buoys on the upper surface thereof. These buoys include shells having portions spaced from the lid structure, and parts for supporting the lid structure during advanced diminution of the liquid level are attached to the spaced shell portions of at least a majority of the buoys and to other portions of the floating roof, and extend through the latter buoys.

In each embodiment at least a majority of said plurality of buoys has a length greater than its width, and a width greater than its height, to effect a relatively long and stiff low silhouette, thereby imparting stiffening to the interconnections paralleling the longest buoy dimension between the plate which forms the base of the buoy and adjacent plates.

16 Claims, 9 Drawing Figures

FLOATING ROOF FOR LIQUID STORAGE TANKS

This application is a continuation of co-pending application Ser. No. 342,454, filed Mar. 19, 1973, now abandoned.

BACKGROUND OF THE INVENTION

1. Field of the Invention

The subject invention relates to storage tanks for liquids, such as liquid hydrocarbon products, and, more particularly, to floating roof structures for liquid storage tanks. 2. Description of the Prior Art Floating roofs for liquid storage tanks are well known and are in widespread use all over the civilized world. The most typical application of these floating roofs is in the storage of liquid hydrocarbons, but no limitation to that application is intended herein.

Early prior-art proposals utilized a single floating deck, as may for instance be seen from U.S. Pat. No. 1,493,091, by J. H. Wiggins, issued May 6, 1924. These early constructions were subject to capsizing, which tendency was attempted to be alleviated by providing a large number of drainpipes designed to act as trusses for maintaining the deck in a horizontal position. This solution was not satisfactory from a design and safety standpoint. The single-deck construction was, however, retained for smaller installations, as may be seen from German Pat. No. 607,596, by Servan Georges Cantacuzene, dated Jan. 30, 1932. Despite a provision of annular floats, no reliable safeguards were present against capsizing of the floating deck in the case of heavy winds or rain water loads.

The floating roof was thus made of stiffer construction and provided with a plurality of buoys located below the deck and submerged in the covered liquid, as may be seen in U.S. Pat. No. 2,036,372, by J. A. Stough, issued Apr. 7, 1936. In practice, the presence of these submerged buoys encouraged the formation of gas pockets which formed under the floating roof. In consequence, the deck corroded more rapidly, which led to explosions in some instances and in others caused capsizing of the roof when loaded with water, and the like accidents.

Accordingly, a construction was developed in which the buoys were located on top of the floating deck, to prevent sinking of the deck in the case of leaks in the deck structure. As may be seen from U.S. Pat. No. 2,359,416, by H. Hammeren, issued Oct. 3,1944, these above-deck buoys typically had the form of rectangular parallelepipeds (prisms with six rectangular faces). This above-deck buoy configuration was unfavorable in practice in that it led to undesired movements and capsizing of the floating roof during heavy storms and impeded a rapid removal of heavy atmospheric precipitation.

As may be seen from U.S. Pat. No. 2,586,856, by C. M. Orr et al, issued Feb. 26, 1952, and U.S. Pat. No. 3,269,583, by A. F. Fino, issued Aug. 30, 1966, double deck constructions became favored for larger floating roof designs. This construction had the advantage that a smooth top surface could be provided on the roof, despite a high floating capability. In practice, this advantage was, however, typically outweighed by the more expensive and heavier construction. Accordingly, attempts were made to construct single-deck floating roofs with only peripheral pontoon structures, as seen in U.S. Pat. No. 2,834,289, by R. C. Ulm, issued July 15, 1958, and U.S. Pat. No. 2,913,138, by J. M. Swick, issued Nov. 17, 1959. However, a limitation to peripheral pontoons typically was only suitable for smaller designs.

Accordingly, proposals with below-deck buoys again came into vogue, as may be seen from U.S. Pat. Nos. 3,288,322 and 3,362,562, by D. D. Marshall et al, issued Nov. 29, 1966, and Jan. 9, 1968, respectively.

More current prior-art proposals revert to the above-deck buoy construction, employing a large number of buoys distributed over a single deck on top thereof. These proposals advocate the use of buoys of either cylindrical or rectangular prismatic configuration. In the cylindrical configuration, the circular surface traced by the generatrix is in a plane parallel to the single deck, while the elemental lines of the cylindrical configuration are perpendicular to the deck. In the prismatic configuration, the buoy has four rectangular sides perpendicular to the deck and a rectangular top side. In both types of configurations, the buoys have flat top sides extending in parallel to the floating deck. While the cylindrical configuration would be aerodynamically and hydrodynamically more favorable than the prismatic configuration, no preference is in the prior art given to the former over the latter. This is presumably due to the fact that a cylindrical configuration, in the orientation under consideration, presents an improvement in terms of air resistance by only a factor of about two over rectangular prismatic configurations. Accordingly, a cylindrical configuration of the above mentioned type for the above-deck buoys does not reliably solve the problems raised by rectangular prismatic buoy configurations.

However, there persisted a prejudice in the art to use prismatic buoys with rectangular sides that extended perpendicularly to the deck, or cylindrical buoys whose elemental lines extended also perpendicularly to the deck. With such configurations, the incremental liquid displacement and thus the incremental buoyancy remains constant with progressing submersion of the buoy, since the cross section of the buoy in parallel to the deck is constant from the bottom to the top of the buoy. Requisite buoy volumes and available buoyancies became thus easier to calculate. However, this convenience was bought at an exorbitant price, as buoys of this configuration rendered the floating roof vulnerable to the impact of high winds and wind-driven rain and sleet. In particular, high wind action on these prior-art buoys promoted undulating motion of the deck structure with consequent fatigue cracking of the deck seams or welds.

In a similar vein, the need arose in practice to provide for a support of the floating roof structure not only during construction, but also upon advanced diminution of the liquid level in the tank, so as to avoid a settling of the roof on the bottom of the tank. As may be seen in the above mentioned U.S. Pat. No. 2,586,856, by C. M. Orr et al, a typical prior-art support design included adjustable supporting posts releasably retained in tubular members which were attached to both decks of a double-deck floating roof structure. In the case of single-deck floating roofs, the stability for the roof supports provided in the latter case was not available from the roof structure itself. Accordingly, as may be seen from U.S. Pat. No. 2,464,803, by F. L. Goldsby et al., issued Mar. 22, 1949, special bracing plates and bracing rod arrays were required for lending some stability to the roof support pipes. This rendered the floating roof design more cumbersome and expensive and impeded construction on a prefabricated basis.

To provide a floating cover that could accommodate wave movements in the liquid, some prior-art proposals, such as British Patent Specification No. 876,436 by Shell, advocate the use of a thermoplastic foil for the cover. This foil is maintained floating by concentric or parallel tubular pontoons. Covers of this type are difficult to install and difficult to maintain in a gas and liquid tight condition. Also, due to the flexible nature of thermoplastic foil materials, a partial immersion of the tubular pontoons or of their silhouettes with attendant gas pocket formation cannot generally be avoided.

For these and other known reasons, prior-art floating roofs have difficulties meeting prevailing API requirements relating to punctured decks and rainfall load carrying capacity.

SUMMARY OF THE INVENTION

It is broadly an object of this invention to overcome the above mentioned disadvantages.

It is a further object of this invention to provide improved floating roofs for liquid storage tanks of the type described.

It is a related object of this invention to provide improved floating roofs in which decks composed of interconnected plates exhibit optimum resistance to wind action and minimum vulnerability to fatigue cracking.

And it is a still further object of this invention to provide floating roofs for liquid storage tanks with improved equipment for supporting the roof during advanced diminution of the liquid level in the storage tank.

Other objects of this invention will become apparent in the further course of this disclosure.

From one aspect thereof, the subject invention resides in a floating roof for a liquid storage tank comprising, in combination, means for covering the liquid contents of the storage tank including a lid structure comprising a plurality of fluid tight interconnected plates of fluid tight material, and auxiliary means for imparting buoyancy to the lid structure including a plurality of buoys, each buoy of at least a majority of the buoys including a base formed of one of said plates, and further including structure attached to said base and having at least two sides inclined relative to a perpendicular plane through the lid structure and inclined toward each other as seen from the lid structure. Each buoy of said at least a majority of buoys has a length greater than its width, and a width greater than its height, to effect a relatively long and stiff low silhouette. In this manner the buoy acts in the manner of a beam, imparting stiffening to the interconnections paralleling the longest dimension of said buoy between the plate which forms the buoy base and the adjacent plates.

In practice, each of the inclined two sides may be flat, providing a triangular or trapezoidal buoy cross section in a plane perpendicular to the deck. However, in accordance with a preferred embodiment of the subject invention, each buoy of at least a majority of buoys includes structure having a convex outer surface extending through the above mentioned perpendicular plane and having a length greater than its width. An annular buoy may be provided at the periphery of the lid structure, which may further be provided with peripheral seal means. The lid structure has an essentially flat surface for contacting an essentially flat top surface of the liquid contents of the storage tank, and the buoys of at least a majority of buoys are located opposite the latter contacting surface.

From another aspect thereof, the subject invention resides in a floating roof for a liquid storage tank comprising, in combination, means for covering the liquid contents of the storage tank including a single-deck lid structure, auxiliary means for imparting buoyancy to the lid structure including a plurality of long and stiff low silhouette buoys including shells having portions spaced from the lid structure, and means for supporting the lid structure during advanced diminution of the liquid level of the storage tank contents including a plurality of supporting means having parts extending through at least a majority of said buoys, said parts being attached to the spaced shell portions of the buoys through which the parts extend and to other portions of the floating roof.

From yet another aspect thereof, the subject invention relates to a floating roof for a liquid storage tank comprising, in combination, means for covering the liquid contents of the storage tank including a lid structure comprising a plurality of fluid tight interconnected plates of fluid tight material, auxiliary means for imparting buoyancy to the lid structure including a plurality of buoys attached to and distributed over the lid structure, each buoy of at least a majority of buoys including a base formed of one of said plates, and further including structure attached to said base and having at least two sides inclined relative to a perpendicular plane through the lid structure and inclined toward each other as seen from the lid structure, said buoy structure having a length greater than its width, and a width greater than its height to effect a relatively long low silhouette and impart stiffening to the interconnections paralleling the longest dimension of the buoy between each buoy base plate and its adjacent plates, and means for supporting the lid structure upon advanced diminution of the liquid level of the storage tank contents including a plurality of supporting means having parts attached to buoy portions between said inclined sides, and extending through at least a majority of said buoys.

From another aspect thereof, the subject invention resides in a method of providing a floating roof for a liquid storage tank. The invention according to this aspect resides, more specifically, in the improvement comprising in combination the steps of providing a floating lid structure, providing this floating lid structure with auxiliary buoys, each having a length parallel to the lid structure greater than its width and a width greater than its height, orienting these buoys in parallel to each other as to their lengths, determining the prevailing wind direction at the site of the roof, and orienting the lid structure with the buoys essentially in parallel to the prevailing wind direction as to the lengths of the buoys. This aspect of the invention further optimizes the resistance of the roof to wind action and its vulnerability to fatigue cracking.

The latter orientation can be effected during assembly of the lid structure and buoys, as well as during operation of the floating roof. If effected during assembly, damage to the roof and its supports during construction and due to wind action is practically eliminated.

BRIEF DESCRIPTION OF THE DRAWINGS

The subject invention will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
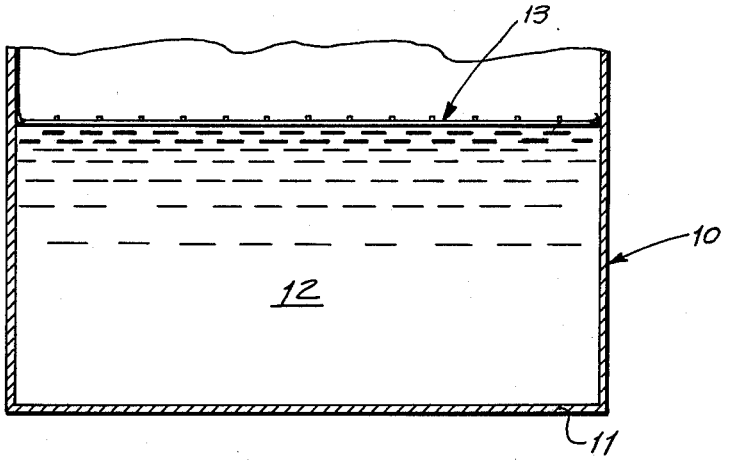
FIG. 1 is a cross section through a liquid tank structure with floating roof showing in a somewhat diagrammatic manner and for the purpose of general orientation the relationship of the roof relative to the tank structure.

By way of general orientation, FIG. 1 shows part of a hollow-cylindrical liquid tank 10 in cross section. The tank 10 has a bottom 11 above which there is stored a liquid 12. Typical stored liquids include liquid hydrocarbons, but no limitation to this type of liquid is intended herein. A floating roof 13 has a single-deck lid structure 14 which floats on the top surface of the stored liquid 12. As liquid is drained from the tank 10, the floating roof 13 will follow the declining liquid level downwardly toward the bottom 11 of the tank. Conversely, as liquid is pumped or fed into the tank for storage purposes, the floating roof will follow the rising liquid level in a direction away from the tank bottom 11. No tank filling and emptying means have been shown, since such means may be of a conventional design and do not form part of the subject invention.

Figure 2:
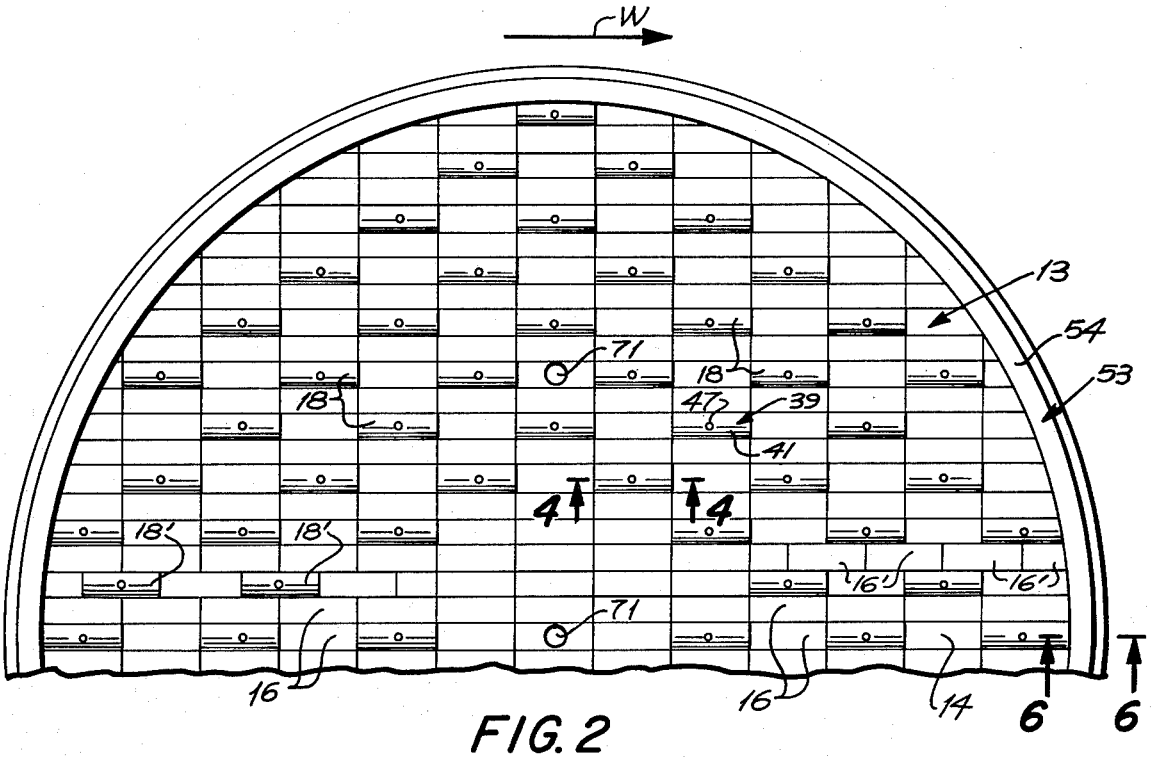
FIG. 2 is a top view of a floating roof in accordance with a preferred embodiment of the subject invention.
Figure 3:
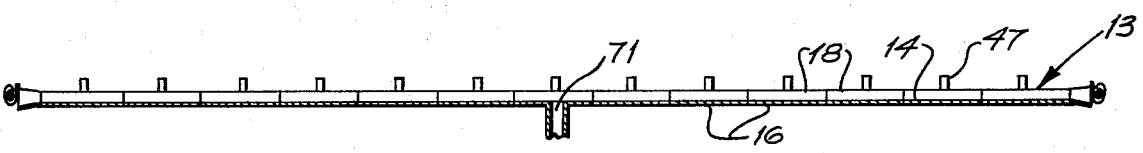
FIG. 3 is a diametrical section through the roof according to FIG. 2.

FIGS. 2 and 3 show the floating roof 13 on an enlarged scale. As seen in these figures, the lid structure 14 of the floating roof 13 comprises a multitude of plates 16 which are interconnected at their edges to form a unitary lid structure. The plates 16 are typically of steel and are welded together at their edges to provide fluid tight, that is, gas and liquid tight seams. Materials other than steel and techniques other than welding may, of course, be employed as long as the requisite properties of the lid structure 14 in terms of strength, fluid tightness and durability are provided.

If desired, the roof may be provided with a centerweight of the type disclosed in U.S. Pat. No. 2,843,289, issued July 15, 1958, and herewith incorporated by reference herein.

A multitude of auxiliary buoys 18 is distributed over the lid structure 14. In the illustrated preferred embodiment, the lid structure 14 has an essentially flat bottom surface 19 for contacting an essentially flat top surface of the liquid contents 12. The buoys 18 are located opposite this contacting surface 19. This is to say that, in the illustrated preferred embodiment, no portions of the buoys 18 project into the liquid below the bottom surface 19 of the lid structure 14. In this manner, a contribution of the buoys 18 to the formation of dangerous gas pockets or inclusions below the floating roof 13 is reliably precluded. Nevertheless, due to the configurations of the buoys within the scope of the subject invention, it should be understood that the buoys herein disclosed are capable of reducing a formation of gas pockets over prior-art structures, even if they would project into the liquid below the surface 19. Accordingly, the subject invention in its broad aspects is not limited to a location of the buoys 18 above the surface 19 although that location conforms to the most preferred embodiment of the subject invention.

Figure 7:
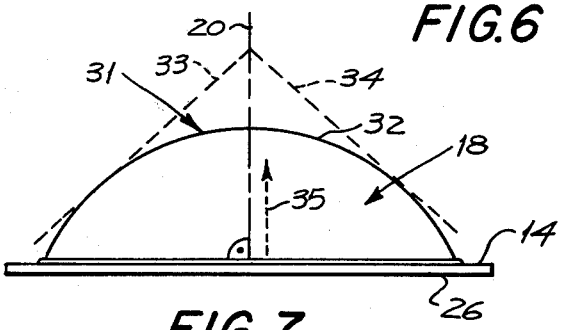
FIG. 7 is a side view of a buoy according to a preferred embodiment of the subject invention, together with a schematic illustration of an important principle of the subject invention.
Figure 8:
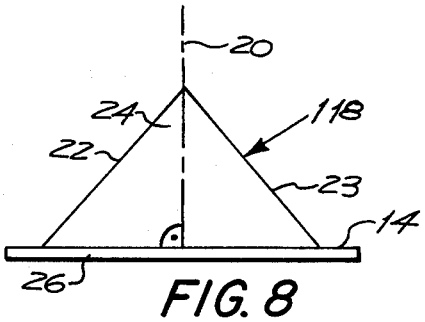
FIG. 8 is a side view of a further buoy in accordance with a preferred embodiment of the subject invention.
Figure 9:
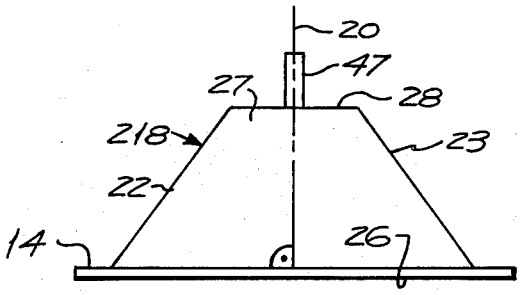
FIG. 9 is a side view of yet another buoy in accordance with a preferred embodiment of the subject invention.

By way of temporary digression, the principle of buoy construction as well as alternative buoy configurations in accordance with the subject invention will now be considered with the aid of FIGS. 7 to 9. Each of the buoys has a base 26 or 38 formed of one of the plates 16 of the lid structure 14. In accordance with a further important principle of the subject invention, at least two sides of each of the buoys in question are inclined relative to a perpendicular plane through the lid structure 14 (meaning a plane which is perpendicular to the essentially flat lid structure or which intersects this lid structure at right angles), and are inclined toward each other as seen from the lid structure. As seen in FIGS. 7 to 9 and also in FIGS. 4 and 5, the latter condition can be satisfied by several buoy configurations, all of which are within the scope of the subject invention, although not necessarily on the same level of preference. As can clearly be seen from all the drawings, the length of each buoy is greater than its width, which in turn is greater than its height, such dimensional relationship making for a buoy configuration of a relatively long and stiff low silhouette.

More specifically, FIG. 8 shows a buoy 118 which has a triangular cross section and includes at least two sides 22 and 23 inclined relative to a plane 20 through the lid structure 14 and inclined toward each other as seen from the lid structure. The sides 22 and 23 may form part of a liquid and gas-tight shell 24 which may have other inclined sides to form a pyramid-shaped buoy, or which may have a pair of vertical terminal sides to complete a triangular-prismatic buoy configuration. The bottom of the buoy 118 may be formed by a flat plate 26 which either forms part of the lid structure 14 or which is attached to such lid structure.

FIG. 9 shows a buoy 218 in which the inclined sides 22 and 23 are integral with a top plate 28 extending between the sides 22 and 23. If a trapezoidal buoy is desired, two vertical plates, one of which is seen at 27, may be welded to the inclined sides 22 and 23. Alternatively, two more inclined sides may be employed to provide a buoy 218 in the form of a truncated pyramid.

If desired, the shells of the buoys 118 and 218 may be symmetrical relative to a vertical line through the plane 20 (a line which is perpendicular to the lid structure 14) so as to provide a conical buoy configuration in the case of the buoy 118 of FIG. 8, or a frustoconical buoy configuration in the case of the buoy 218 of FIG. 9. In these latter cases, the two inclined buoy sides according to the subject invention are, for the purpose of definition, considered to be two opposite elemental portions of the conical or frustoconical buoy shell. As is implied in the phrase "at least two" the presence of a multitude of mutually inclined elemental shell portions is well within the scope of the subject invention.

In accordance with the preferred embodiment illustrated in FIG. 7, the buoy 18 includes a shell 31 or other buoyance structure having a convex outer surface 32 extending through the plane 20. In fact, the convex outer surface 32 extends from the lid structure 14 through the perpendicular plane 20 back to the lid structure 14, whereby the entire outer surface of the buoy shell is convex (rather than only a minor top portion thereof). The shell 31 according to FIG. 7 may be dished to form part of a sphere, ellipsoid or similar body. In that case, opposite tangential lines 33 and 34 of the convex surface 32 are inclined relative to the perpendicular plane 20 (or relative to a perpendicular line through the plane 20), and are further inclined toward each other as seen from the lid structure 14 in the direction of an arrow 35. By the same token, opposite elemental portions of the shell 31 (encompassed within the above broad definition of "sides") are inclined relative to the perpendicular line or perpendicular plane 20 and relative to each other as seen from the lid structure 14. The shell 31 may be welded to a base 26 or a portion of the lid structure 14, as in the case of the other buoys herein disclosed.

The principle of the subject invention illustrated in FIG. 7 applies also to hollow-cylindrical shell configurations for the buoys 18. In this respect, the term "cylindrical" in the latter expression is intended to refer broadly to a surface or configuration generated by a line (the element or elemental line) moving in parallel to itself along a given curve (the generatrix). The elemental line extends preferably in parallel to the flat lid structure 14. The genetrix need not be closed in itself. The generatrix may form part of the periphery of a circular plane extending perpendicularly to the lid structure 14 and at right angles to the above mentioned perpendicular plane 20. Other generatrix configurations may be employed within the scope of the subject invention, as long as the resulting cylindrical shell structures have essentially convex outer surfaces.

Figure 4:
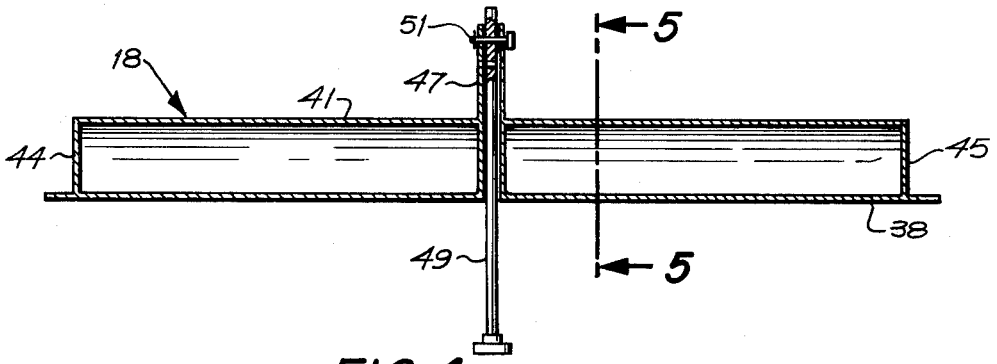
FIG. 4 is a section, taken on line 4 — 4 in FIG. 2, of a buoy according to a preferred embodiment of the subject invention employed on the floating roof of FIG. 2.
Figure 5:
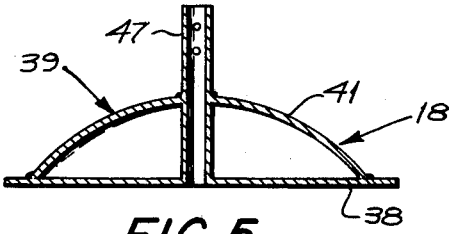
FIG. 5 is a section taken on the line 5 — 5 of FIG. 4.
Figure 6:
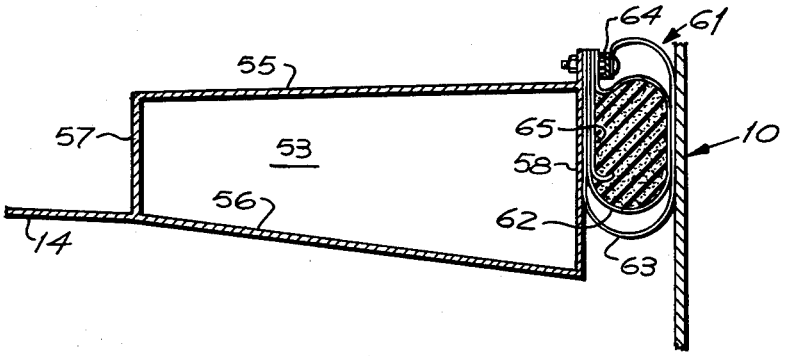
FIG. 6 is a section through a peripheral pontoon taken on the line 6 — 6 of FIG. 2.

A structure for the buoys 18 in accordance with a particularly preferred embodiment of the subject invention is illustrated in FIGS. 4 and 5. According to these figures, each buoy 18 is composed of a base 38 and a shell 39 which is hollow-cylindrical in the above mentioned sense. The hollow-cylindrical shell 39 has a convex part 41, which includes the above mentioned inclined elemental portions, and a pair of vertical terminal plates 44 and 45 which have upper edges conforming to the configuration of the convex part 41 and which are welded to the base plate 38 and to the convex part 41 to form a liquid and gas-tight unit. The convex part 41 is also welded to the base plate 38 for the same purpose.

The base plates 38 are formed by plates 16 of the lid structure 14. This has the important advantage that a leak in the lid structure under any of the buoys 18 will issue only into the particular buoy and will automatically be confined by the buoy shell 39 so as to avoid issuance of the leaking liquid over the lid structure 14. As can be seen from the drawings, in the preferred embodiment of FIGS. 4 and 5, not only is the length of the buoy longer than its width, which in turn is dimensionally larger than its height but, in lateral cross section, the buoy is less than a half cylinder. Such a dimensional relationship follows from a buoy configuration effecting a relatively long and stiff low silhouette which, in the manner of a beam imparts stiffening to the interconnections paralleling the longest dimension of the buoy between the plate which forms the buoy base and its adjacent plates.

The buoys 18 of FIGS. 2 to 5 have tubes 47 extending therethrough. As seen in FIGS. 4 and 5, each tube 47 is welded to the base 38 and to the shell 39 of the corresponding buoy 18. By being thus welded not only to the base 38 or, in effect, to the lid structure 14, but also to a portion of the buoy which is spaced from the baseplate 38, the tube 47 performs the important function of enhancing the structural strength and rigidity of the buoy 18. The tubes 47 thus take the place of other structural supports which would otherwise have to be provided inside the buoy shells. In addition, the tubes 47 perform the important function of serving as tubular members for receiving supporting posts 49. These supporting posts, which are thus distributed over the entire lid structure 14, serve as means for supporting the lid structure relative to the tank bottom 11 during advanced diminution of the liquid level in the tank 10. A settling of the floating roof on the tank bottom is thus reliably avoided. Pins 51 and corresponding apertures in the tubes 47 and posts 49 render the supporting means adjustable.

It will moreover be noted that, in the illustrated preferred embodiments of the subject invention, the tubular members 47 are attached to buoy portions between the inclined sides (including inclined elemental side portions) of the buoy shell. In this manner, the convex buoy shell favorably distributes stresses that occur during a settling of the supporting posts 49 on the tank bottom 11. No complicated and cumbersome bracing plates and bracing rods of the type shown in the above mentioned U.S. Pat. No. 2,464,803 need be provided.

The fact that the inclined or convex buoy sides translate stresses perpendicular to the lid structure into stresses in the plane of the lid structure render the support construction according to the subject invention even more favorable than prior-art support construction which employed a double deck for the floating roof.

The illustrated floating roof 13 has a peripheral circular pontoon structure 53 which may be composed of arcuate pontoon sections 54 arranged along the periphery of the lid structure 14 and having arcuate top and bottom walls 55 and 56 and arcuate side walls 57 and 58. The bottom wall 56 is inclined downwardly as seen from the lid structure 14 so that the peripheral buoy structure 53 provides a desired flotation for the roof when the same rests on the top of the liquid in the tank.

A peripheral seal 61 is attached to and extends around the circular buoy structure 53 to prevent escape of the stored liquid. The seal may be of a conventional type, including an annular, flexible foam casing 62 containing foam material, and a stainless steel band 63 about the foam casing. The foam casing 62 and the steel band 63 are attached to the buoy structure at 64, as is a hold-down 65 inside the foam casing 62. Other peripheral pontoon structures and other peripheral seal structures may be substituted for the structures 53 and 61, respectively, without departing from the scope of the subject invention.

In practice, the subject invention represents a substantial technological advance in the liquid storage tank art. In particular, the buoy configurations according to the subject invention present a materially reduced resistance to wind, wind-driven rain or sleet and other atmospheric precipitation. Improvements in terms of aerodynamic properties by factors on the order of ten are attainable by the subject invention relative to prior-art structures in which above-deck buoys were either rectangularly prismatic or were cylindrical with a circular generatrix extending in parallel to the floating deck. Also, the illustrated buoy configurations lead to an accumulation of the bulk of the buoy cross sections adjacent the lid structure 14, thereby placing the buoyancy in the vicinity of the lid structure for increased stability and reduction of submersion of the lid structure in the case of leaks. Moreover, the buoy structures according to the subject invention convey upon the floating roof 14 an excellent tolerability of heavy loads due to sudden rain or other precipitation. These are important factors in meeting various API requirements relating, for instance to deck puncture and precipitation tolerance.

The subject invention is particularly adapted to the construction of the liquid tanks having diameters in the one-hundred meter range, although the invention may be practiced with medium-size liquid tanks.

No drain system for drain water or other precipitation has been illustrated, since a conventional system may be employed, and since such drain system does not form part of the subject invention.

In constructing the roof, the plates 16 and buoys 18, in accordance with a method according to the subject invention are oriented with their lengths or long sides in parallel to the prevailing wind direction W. This method may also be practiced during operation of the floating roof. This method accentuates the high wind resistance and low fatigue cracking exposure afforded by the relatively long and stiff low silhouette buoys 18 of the subject invention.

Because of such high fatigue cracking resistance, the plates 16 may be arranged in parallel rows whereby straight seams run across the lid structure 14. Alternatively, the plates may be arranged in staggered relationship as shown in FIG. 2 at 16', whereby seams in plates adjacent a buoy 18 are located at the side of the buoy.

For minimum wind resistance, the buoys are arranged in parallel rows as shown. The buoys may be arranged in mutually staggered relationship, as seen, for instance, at 18' in FIG. 2.

Modifications and variations within the spirit and scope of the subject invention will become apparent to those skilled in the art from the subject disclosure.

We claim:

1. A floating roof for a liquid storage tank comprising a single-deck lid of a plurality of fluid-tight interconnected rectangular steel plates and auxiliary means for imparting buoyancy to the lid including a plurality of elongate buoys of low silhuouette on the upper surface of the lid, each buoy having as its base one of the plates and having longitudinal sides inclined toward each other and the base, such that tht the buoy is of increasingly smaller horizontal section from its base to its top and of such construction as to stiffen the junctions between the buoy and adjacent plates.

2. A relatively large floating roof for a liquid storage tank comprising a single-deck lid of a plurality of fluid tight interconnected generally rectangular steel plates adapted to be disposed in liquid contact with the liquid stored in said tank and auxiliary means for imparting buoyancy to the lid including a plurality of elongated buoys of low silhouette on the upper surface of the lid, each buoy having as its base substantially the entire area of one of the plates, and having longitudinal sides inclined toward each other and the base such that the buoy is of increasingly smaller horizontal section from its base to its top, with the longest dimension of the respective buoys being parallel to the junctions of its base plate and the steel plates adjacent thereto, said elongated buoys being distributed over the lid with their lengths in parallel to stiffen the junctions between each buoy base plate and adjacent plates.

3. A floating roof according to claim 2, in which the respective buoys have heights less than their widths.

4. A floating roof according to claim 3 in which the lid includes an annular pontoon about its perimeter.

5. A floating roof according to claim 2 in which said buoys have curved outer surfaces.

6. A floating roof according to claim 5 in which said buoys are in the form of less than a half cylinder or revolution.

7. In a relatively large liquid storage tank floating roof of single-deck lid construction, wherein said lid is of the type formed by the interconnection of a plurality of generally rectangular, substantially uniformly-sized fluid tight plates by welding or the like, said roof having a lower surface adapted to contact and float upon the top surface of said liquid contents in an essentially flat contacting relationship, and having a plurality of auxiliary buoy means arranged upon the upper surface of the roof in substantially uniformly distributed relationship to provide floating support of the roof in the event of deck puncture or precipitation loading, the improvement comprising: each of said plurality of buoys including a base comprising substantially the entire surface of one of the plurality of plates forming the upper surface of said deck lid and further including structure attached to said base above the upper surface of said deck lid to form a closed buoy, each of said plurality of buoys being of increasingly smaller horizontal section from the bottom to the top of said buoys, each of said plurality of buoys having a length greater than its width, and a width greater than its height as measured in a perpendicular vertical plane to effect a relatively long and low buoy silhouette and impart stiffening to the interconnection junctions paralleling the longest dimension of said buoy between each buoy base plate and its adjacent plates.

8. A floating roof for a liquid storage tank, comprising in combination:

means for covering the liquid contents of said storage tank including a lid structure comprising a plurality of fluid tight interconnected plates of fluid tight material, said lid structure having a lower surface adapted to contact the top surface of said liquid contents in an essentially flat contacting relationship; and means for impairing buoyancy to said lid structure including a plurality of buoys, at least a majority of which include a base consisting substantially of a different one of said plates; and further including structure attached to each said buoy base having at least two sides inclined relative to a perpendicular plane through said lid structure and inclined toward each other as seen from the lid structure, said buoy structure having a convex outer surface extending through said plane and having a length greater than its width to effect a relatively long and low silhouette and impart stiffening to the interconnection junctions paralleling the longest dimension of said buoy between each buoy base plate and its adjacent plates, said buoys of at least a majority of buoys being located opposite said lower liquid contacting surface.

9. A floating roof as claimed in claim 8, wherein: said buoy structure has a height which is less than its width.

10. A floating roof as claimed in claim 8, wherein: each of said buoys of at least a majority of buoys includes a dished shell.

11. A floating roof as claimed in claim 8, including: an annular buoy at the periphery of said lid structure.

12. A floating roof as claimed in claim 8, wherein: said covering means include peripheral seal means on said lid structure

13. A floating roof as claimed in claim 8, wherein: said buoys of at least a majority of buoys are distributed over said lid structure.

14. A floating roof as claimed in claim 8 wherein: each of said buoys of at least a majority of buoys includes a hollow-cylindrical shell having its elemental line essentially parallel to said lid structure.

15. A floating roof as claimed in claim 4, wherein: each of said hollow-cylindrical shells is less than a half cylinder.

16. A method of minimizing fatigue cracking due to wind action upon a floating roof for a liquid storage tank of the type wherein the floating roof comprises a lid formed by the interconnection of a plurality of fluid tight plates by welding or the like, said roof having a plurality of buoy means arranged upon the upper surface of the roof to provide floating support of the roof in the event of deck puncture or precipitation loading, comprising the steps of:

constructing each of said plurality of buoys to have a base consisting substantially of a different one of said plurality of plates forming said lid, and further including structure attached to said base upon said deck lid to form a closed buoy of increasingly smaller horizontal section from the base to the top of said buoys, each of said buoys having a length greater than its width, and a width greater than its height to effect a relatively long and low buoy silhouette and impart stiffening to the interconnection junctions paralleling the longest dimension of said buoy between each buoy base plate and its adjacent plate, and orienting said lid structure within said storage tank with the lower surface thereof adapted to contact the top surface of said liquid contents in an essentially flat contacting relationship and with the longest dimension of each of said plurality of buoys being essentially parallel to the prevailing wind direction at the site of the storage tank.

* * * * *

UNITED STATES PATENT AND TRADEMARK OFFICE

CERTIFICATE OF CORRECTION

PATENT NO. : 4,036,394

DATED : July 19, 1977

INVENTOR(S) : Robert W. Bodley, Reign C. Ulm

It is certified that error appears in the above-identified patent and that said Letters Patent are hereby corrected as shown below:

Column 1, line 67, delete "2,834,289" and insert --2,843,289--

Column 7, line 34, delete "genetrix" and insert --generatrix--

Claim 1, line 8 (Column 9, line 56) delete "tht"

Claim 4, line 1 (Column 10, line 11) delete "3" and insert --2--

Claim 6, line 2 (Column 10, line 16) delete "or" and insert --of--

Claim 8, line 10 (Column 10, line 54) delete "impairing" and insert --imparting--

Claim 15, line 1 (Column 11, line 21) delete "4" and insert --14--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*